US007988259B2

(12) United States Patent
Hishida et al.

(10) Patent No.: US 7,988,259 B2
(45) Date of Patent: Aug. 2, 2011

(54) INKJET PRINTER

(75) Inventors: Yuko Hishida, Tomi (JP); Masaru Ohnishi, Tomi (JP); Hironori Hashizume, Tomi (JP)

(73) Assignee: Mimaki Engineering Co., Ltd., Nagano (JP)

( * ) Notice: Subject to any disclaimer, the term of this patent is extended or adjusted under 35 U.S.C. 154(b) by 369 days.

(21) Appl. No.: 12/392,979

(22) Filed: Feb. 25, 2009

(65) Prior Publication Data

US 2009/0219342 A1 Sep. 3, 2009

(30) Foreign Application Priority Data

Feb. 29, 2008 (JP) ..... 2008-051424

(51) Int. Cl.
*B41J 2/14* (2006.01)
*B41J 2/16* (2006.01)

(52) U.S. Cl. ..... 347/51; 347/102

(58) Field of Classification Search ..... 347/51, 347/52, 101, 102
See application file for complete search history.

(56) References Cited

U.S. PATENT DOCUMENTS 7,182,453 B2 * 2/2007 Nakajima ..... 347/102

FOREIGN PATENT DOCUMENTS

JP 2004-188920 7/2004

* cited by examiner

*Primary Examiner* — Thinh H Nguyen
(74) *Attorney, Agent, or Firm* — Ditthavong Mori & Steiner, P.C.

(57) ABSTRACT

An inkjet printer including a UVLED unit which emits ultraviolet light to a print medium supported on a supporting table to cure UV ink droplets deposited on the print medium. The inkjet printer further includes a controller which adjust the light quantity of ultraviolet light, emitted from the UVLED unit to the UV ink droplets deposited on the print medium, from a light quantity for temporary curing to a light quantity for final curing, and a control unit capable of selecting between a two-stage curing mode in which UV ink droplets deposited on the print medium are temporarily cured ant are then finally cured and a single-stage curing mode in which UV ink droplets are finally cured by an irradiation with ultraviolet light at one time by means of the UVLED unit and the controller.

15 Claims, 11 Drawing Sheets

INKJET PRINTER

CROSS-REFERENCE TO RELATED APPLICATION

The present application claims priority under 35 U.S.C. §119 to Japanese Patent Application No. 2008-051424, filed on Feb. 29, 2008, the entire contents of which are herein incorporated by reference.

BACKGROUND OF THE INVENTION

1. Field of the Invention

The present invention relates to an inkjet printer.

2. Discussion of the Background

Conventionally, there is known an inkjet printer in which ink is ejected from a print head, which is disposed to face a platen, onto a print medium put on the platen while reciprocating the print head in a left-right direction so as to print the print medium. As one of such inkjet printers, there is a printer of a type ejecting ultraviolet curable ink (hereinafter, referred to as UV ink) having a property that it is cured when irradiated with ultraviolet light. Since the UV ink has excellent weather resistance and excellent water resistance, the UV ink allows printed matters to be used as outdoor advertising posters or the like. Therefore, the UV ink has the advantage that the printed matters can be used for various purposes as compared to printed matters printed with water-soluble ink.

By the way, an inkjet printer of a type ejecting UV ink to print is provided with an ultraviolet light irradiation device for irradiating the UV ink deposited on the print medium with ultraviolet light to cure the UV ink. In recent years, an inkjet printer has been developed in which an ultraviolet light emitting diode (hereinafter, referred to as UVLED) is used as a light source for emitting ultraviolet light in the ultraviolet light irradiation device (see, for example, JP-A-2004-188920).

As shown in FIG. 11(*a*), a conventional print unit 500 has a right ultraviolet light irradiation device 520R and a left ultraviolet light irradiation device 520L which are disposed in pairs on the right and left sides of the print head 510 and in which UVLEDs are arranged. The right ultraviolet light irradiation device 520R and the left ultraviolet light irradiation device 520L are adapted to emit ultraviolet light toward the print medium 501 located below the print unit 500. For ease of explanation, the following description will be made according to definition that directions shown by arrows shown in FIG. 11(*a*) are the forward, backward, leftward, and rightward directions, respectively. The print head 510 includes, for example, a magenta print head 510M for ejecting magenta UV ink droplets from a plurality of nozzles (not shown) formed in the bottom toward the print medium 501, an yellow print head 510Y for ejecting yellow UV ink droplets similarly, a cyan print head 510C for ejecting cyan UV ink droplets similarly, and a black print head 510K for ejecting black UV ink droplets similarly.

To conduct printing on a printing line 508 of the print medium 501, UV ink droplets are ejected from the respective nozzles of the print head 510 so that the UV ink droplets are superposed in predetermined patterns on a printing line 508 while reciprocating the print unit 500 above the printing line 508 a predetermined number of passes. During this, the right ultraviolet light irradiation device 520R and the left ultraviolet light irradiation device 520L emit ultraviolet light of strength capable of completely curing UV ink. The printing line 508 is irradiated with the ultraviolet light so as to cure the UV ink deposited on the printing line 508. In this manner, the printing is conducted.

FIGS. 11(*b*) and 11(*c*) are sectional views showing states that UV ink droplets ejected from nozzles are deposited on the printing line 508 on the way of printing on the printing line 508. FIG. 11(*b*) shows a state that uncured UV ink droplets 512 are ejected at the current pass and deposited on completely cured UV ink droplets 511 which were ejected at the last pass and deposited on the printing line 508 and which were irradiated with ultraviolet light and thus completely cured. Since the UV ink droplets 511 are completely cured, the affinity of the uncured UV ink droplets 512 for the completely cured UV ink 511 are poor so that the uncured UV ink droplets 512 are deposited in a raised shape like beading because of surface tension. After the uncured UV ink droplets 512 are deposited in a beading state, the uncured UV ink droplets 512 spread very little until irradiation with ultraviolet light because of poor affinity and is then completely cured in this state by irradiation with ultraviolet light.

On the other hand, FIG. 11(*c*) shows a state that uncured UV ink droplets 514 are ejected at the current pass and deposited on uncured UV ink droplets 513 which were ejected at the last pass and deposited on the printing line 508 and which were not cured (cured very little). The affinity of the later uncured UV ink droplets 513 for the prior uncured UV ink droplets 514 are good so that, after the later uncured UV ink droplets 513 are deposited in a beading state, the later uncured UV ink droplets 513 are mixed with the prior uncured UV ink droplets 514 and thus bleed. The later uncured UV ink droplets 514 and the prior uncured UV ink droplets 513 are mixed so as to form a mixed UV ink 515. The mixed UV ink 515 is irradiated with ultraviolet light and is thus completely cured.

By the way, for printing on the print medium 501 by the print unit 500, it is preferable that UV ink droplets deposited and superposed on the print medium 501 are not mixed and thus do not bleed, but the UV ink droplets spread and are thus leveled. In this case, the print medium 501 with desired printing (desired printed matter) can be obtained. However, when the uncured UV ink droplets 512 are superposed on and adhere to the completely cured UV ink droplets 511 as shown in FIG. 11(*b*), the completely cured UV ink droplets 511 and the uncured UV ink droplets 512 are not mixed and thus do not bleed. However, the completely cured UV ink droplets 511 reject the uncured UV ink droplets 512 so that the uncured UV ink droplets 512 may be cured by irradiation with ultraviolet light in the state remaining a raised shape like beading on the surface of the completely cured UV ink droplets 511. As compared to the desired printed matter, the printed matter in which UV ink droplets are cured in the state remaining the beading shape may have poorer print quality because reflection of light from the printed matter may differ so as to cause difference in vision (optical fringes).

When the later uncured UV ink droplets 514 are superposed on and adhere to the prior uncured UV ink droplets 513 as shown in FIG. 11(*c*), the later uncured UV ink droplets 513 may be mixed with the prior uncured UV ink droplets 514 and thus bleed so that the UV ink droplets may be cured by irradiation with ultraviolet light in the mixed and bleeding state. As compared to the desired printed matter, the printed matter in which UV ink droplets are cured in the mixed and bleeding state may have poorer print quality because a mixed and bleeding portion of the printed matter has different color in vision.

In addition, some UV inks have a feature that the volume of the ink itself is reduced (i.e. contracts) while being cured by irradiation with ultraviolet light. If using UV ink having such contraction feature, a phenomenon that a cured portion of ink attracts uncured portion of ink around the cured portion is caused because of the contraction. This phenomenon produces indented patterns (curing fringes) on the surface of the printed matter and is thus one of leading causes of optical fringes.

Although there is a problem of poor print quality because the UV ink droplets are cured in the state remaining a beading shape or the UV ink droplets are cured in the mixed and bleeding state, higher printing speed is sometimes required rather than the print quality depending on the applications of printed matters.

SUMMARY OF THE INVENTION

The present invention is made to address the aforementioned problems and it is an aspect of the present invention is to provide an inkjet printer which can select a mode of providing improved print quality by superposing UV inks in a leveled state and not to bleed or a mode of providing improved printing speed rather than the print quality depending on the applications of printed matters.

Thus, an embodiment of the present invention provides an inkjet printer of a type in which a print head is arranged to face a print medium supported on a medium supporting means (for example, the supporting table 12 in the embodiment) and ejects ink droplets while moving said print head relative to said print medium so as to conduct desired printing on the surface of said print medium, and which comprises: an ultraviolet light irradiation means (for example, the left UVLED unit 70L and the right UVLED unit 70R in the embodiment) which emits ultraviolet light toward the print medium supported on said medium supporting means to cure the ink droplets deposited on said print medium; an irradiation light quantity control means (for example, the controller 23 in the embodiment) which adjusts the light quantity of ultraviolet light, emitted from said ultraviolet light irradiation means to the ink droplets deposited on said print medium, from a light quantity for temporarily curing said ink droplets to a light quantity for finally curing said ink droplets; and a mode switching means (for example, the control unit 20 in the embodiment) which is capable of selecting between a two-stage curing mode in which UV ink droplets deposited to said print medium are temporarily cured and are then finally cured and a single-stage curing mode in which UV ink droplets are finally cured by an irradiation with ultraviolet light at one time by means of said ultraviolet light irradiation means and said irradiation light quantity control means.

It is preferable that the aforementioned inkjet printer comprises a light source moving means (for example the base portion 51, the carriage 63, and the leftward-rightward driving mechanism 69 in the embodiment) for moving said ultraviolet light irradiation means along and relative to said print medium, wherein said irradiation light quantity control means is capable of adjusting the light quantity of ultraviolet light irradiating the ink droplets deposited on said print medium from the light quantity for temporarily curing said ink droplets to the light quantity for finally curing said ink droplets by adjusting at least one of the irradiation intensity by said ultraviolet light irradiation means and the moving speed of said ultraviolet light irradiation means by said light source moving means.

It is preferable that, in the aforementioned inkjet printer, said ultraviolet light irradiation means comprises light-emitting diodes (for example, the UVLEDs 72 in the embodiment) for emitting ultraviolet light toward said print medium.

Embodiments of the inkjet printer of the present invention can select between the two-stage curing mode in which ink droplets deposited on the print medium are temporarily cured and are then fully cured and the single-stage curing mode in which ink droplets are finally cured by irradiation with ultraviolet light at one time. According to this structure, when printing in the two-stage curing mode, uncured ink droplets are irradiated with ultraviolet light of such a light quantity as to temporarily cure the ink droplets so that the ink becomes to a gel state, i.e. the temporarily cured state, ensuring good affinity allowing the ink droplets to be leveled over time on the print medium or other ink droplets but not allowing the ink droplets to be mixed with the abutting other ink droplets and to bleed. Accordingly, the temporarily cured ink droplets in the gel state deposited on the print medium are leveled over time on the print medium and are not mixed with other temporarily cured ink droplets and thus do not bleed. As uncured ink droplets are deposited and superposed on the temporarily cured ink droplets, the uncured ink droplets are not rejected by the temporarily cured ink droplets and are thus leveled over time, while the ink droplets are not mixed with each other and do not bleed. Therefore, by superposing the temporarily cured ink droplets on the print medium in the leveled state without bleeding and then irradiating the temporarily cured ink droplets with ultraviolet light of a light quantity for finally curing the ink droplets, the temporarily cured ink droplets are finally cured and are fixed to the print medium, thereby improving the print quality. Even when using UV ink droplets having contraction feature, the UV ink droplets are cured in stages so as to reduce the affect of contraction feature, as compared to the case that UV ink droplets are completely cured by irradiation with ultraviolet light at one time, thereby improving the print quality.

On the other hand, when printing in the single-stage curing mode, uncured ink droplets deposited on the print medium are irradiated with ultraviolet light of a light quantity for finally curing the ink droplets so that the ink droplets are fixed to the print medium. As compared to the printing in the two-stage curing mode, the number of passes can be reduced for the action for temporarily curing the uncured ink droplets, thereby improving the printing speed rather than the print quality depending on the applications of printed matters.

It is preferable that the aforementioned inkjet printer comprises the light source moving means for moving the ultraviolet light irradiation means along and relative to the print medium, wherein the irradiation light quantity control means is capable of adjusting the light quantity of ultraviolet light irradiating the ink droplets deposited on the print medium from the light quantity for temporarily curing the ink droplets to the light quantity for finally curing the ink droplets by adjusting at least one of the irradiation intensity by the ultraviolet light irradiation means and the moving speed of the ultraviolet light irradiation means by the light source moving means. According to this arrangement, the light quantity of ultraviolet light for irradiating the UV ink droplets can be finely adjusted as compared to the case of controlling only the irradiation intensity by the ultraviolet light irradiation means, thereby curing the ink droplets to more desirable curing degree. Since the ink droplets are finally cured after temporarily cured (that is, cured in stages), only single ultraviolet light irradiation means is able to cure the UV ink droplets in stages, thereby reducing the apparatus size as compared to an inkjet printer having two ultraviolet light irradiation means for temporary curing and final curing.

It is preferable that, in the aforementioned inkjet printer, the ultraviolet light irradiation means comprises light-emitting diodes for emitting ultraviolet light toward the print medium. According to this structure, the irradiation intensity of ultraviolet light of the light-emitting diodes can be changed subserviently by variation in current value of the supply current. Therefore, in response to the control of irradiation intensity including the ON/OFF control, it is possible to irradiate the ink droplets with ultraviolet light of desired irradiation intensity with very little time lag. In addition, since the light-emitting diodes are small and lightweight, the influence on the movement accuracy and the moving speed of the print head in case of an arrangement that the ultraviolet light irradiation means moves together with the print head is minimized, thereby improving the print quality.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF EXEMPLARY EMBODIMENTS OF THE INVENTION

Figure 1:
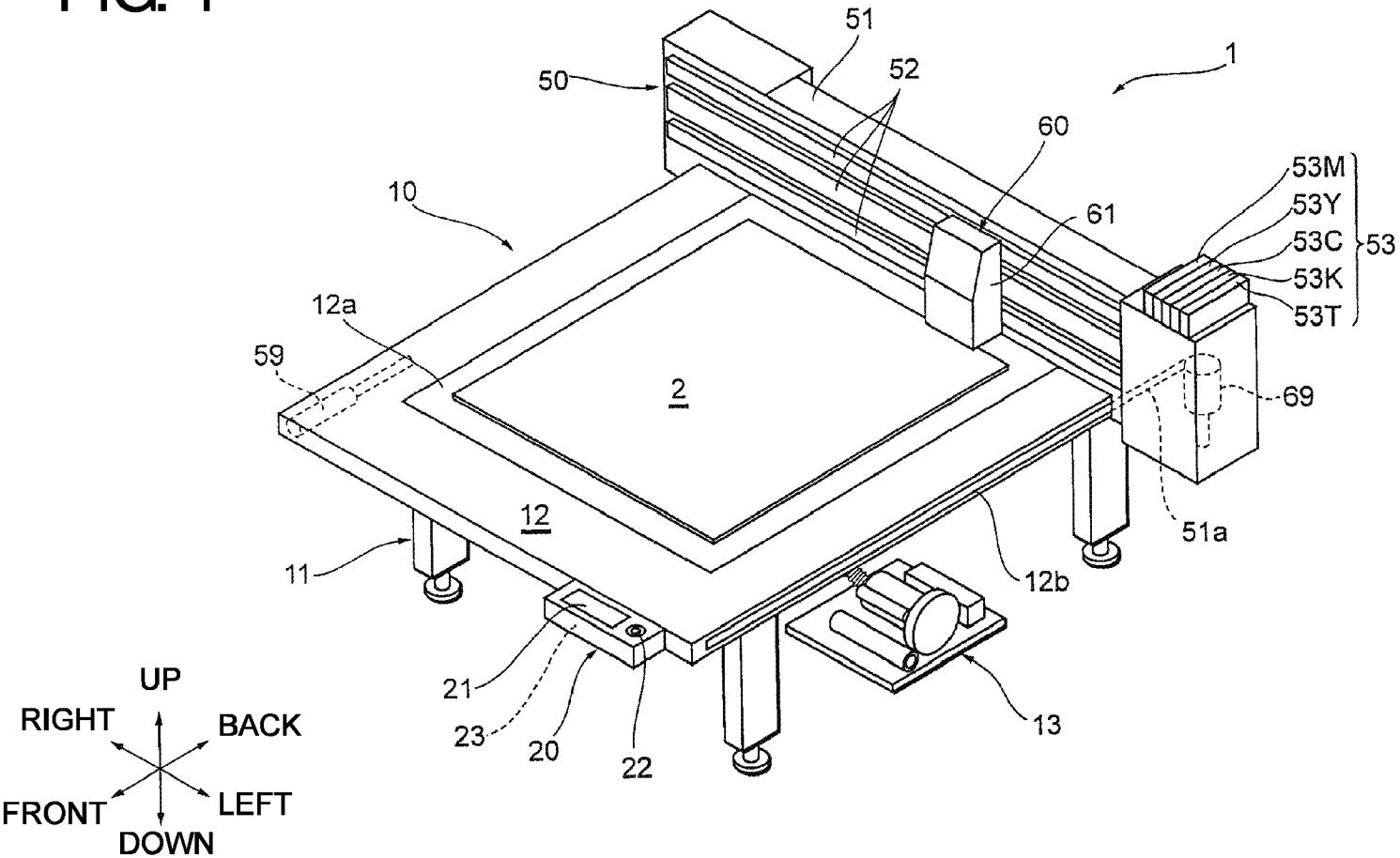
FIG. 1 is a perspective view showing an inkjet printer according to an embodiment of the present invention.

Embodiments of the present invention will be described hereinafter with reference to the accompanying drawings. In the following description, the constituent elements having substantially the same function and arrangement are denoted by the same reference numerals, and repetitive descriptions will be made only when necessary. The embodiments of the present invention have the following arrangements.

As an example of an inkjet printer to which the present invention is applied, an inkjet printer 1 which conducts desired printing relative to a print medium by moving a print unit in two perpendicular axial (X-axis Y-axis) directions in a horizontal plane relative to the print medium fixed and held on a table is shown in FIG. 1 in a perspective view taken from oblique front. For the sake of convenience, in FIG. 1, directions indicated by arrows will be forward, backward, leftward, rightward, upward, and downward directions, respectively in the following description.

The inkjet printer 1 comprises a supporting section 10 as a lower portion composing a base structure and a printing section 50 which is arranged such that it is movable above the supporting section 10. The supporting section 10 mainly comprises a main frame 11, a supporting table 12, a vacuum blower 13, and a control unit 20. The main frame 11 horizontally supports the supporting table 12 which is placed on and fixed to the main frame 11 and also functions as mounting base for respective mechanisms. The supporting table 12 is formed to have a rectangular shape in a planar view and is provided at its center with a vacuum table 12*a* which fixes and holds a flat sheet-like print medium 2 put thereon. The surface of the vacuum table 12*a* is provided with a number of small holes which vertically penetrate the vacuum table 12*a*. These holes communicate with a decompression chamber (not shown) formed below the vacuum table 12*a*. The vacuum table 12*a* is also provided with guide grooves 12*b*, 12*b* which are formed in the left and right side surfaces to extend in the anteroposterior direction and to which anteroposterior guides 51*a*, 51*a* formed on left and right sides of the printing section 50 as will be described later are fitted.

The vacuum blower 13 communicates with the decompression chamber and exhausts air from the decompression chamber to set the decompression chamber to have a negative pressure or sends air into the decompression chamber to discharge air through the holes. The print medium 2 is placed at an original position on the vacuum table 12*a* and the decompression chamber is set to have negative pressure by the vacuum blower 13 so that the print medium 2 is vacuumed and adsorbed onto the surface of the vacuum table 12*a*, thereby fixing and holding the print medium 2. For removing the print medium 2 from the vacuum table 12*a* after desired printing onto the print medium 2 is terminated, air is sent to the decompression chamber and is discharged from the holes so as to float the print medium 2, whereby the print medium 2 can be easily removed.

The printing section 50 mainly comprises a base portion 51, guide rails 52, and a print unit 60. The base portion 51 is formed into a substantial rectangular solid extending in the left-right direction and has anteroposterior guides 51*a*, 51*a* formed near the left and right ends thereof which are fitted into the guide grooves 12*b*, 12*b* so that the base portion 51 can freely slide in the anteroposterior direction in a state extending above the supporting table 12. The base portion 51 is moved in the anteroposterior direction (X-axis direction) by a forward-backward driving mechanism 59. The upper and lower guide rails 52 are paired and are formed in the front surface of the base portion 51 to extend in the left-right direction. Left-right guides 65 formed in the back surface of a carriage 63 as will be later are fitted into the guide rails 52, thereby supporting the print unit 60 such that the print unit 60 can freely slide in the left-right direction.

Since driving mechanisms of various kinds may be employed as the forward-backward driving mechanism 59, the detailed description and illustration of the forward-backward driving mechanism 59 will be omitted in this specification. For example, the forward-backward driving mechanism 59 may be composed of a ball screw which is disposed below the supporting table 12 to extend in the anteroposterior direction parallel to the guide grooves 12*b*, a servo motor for rotating the ball screw, and a ball nut which is screwed onto and supported by the ball screw and is fixed to the base portion 51. The forward-backward driving mechanism 59 moves the base portion 51 in the anteroposterior direction by a moving distance (feeding distance) corresponding to an operation signal outputted from a controller 23 as will be described later.

Figure 2:
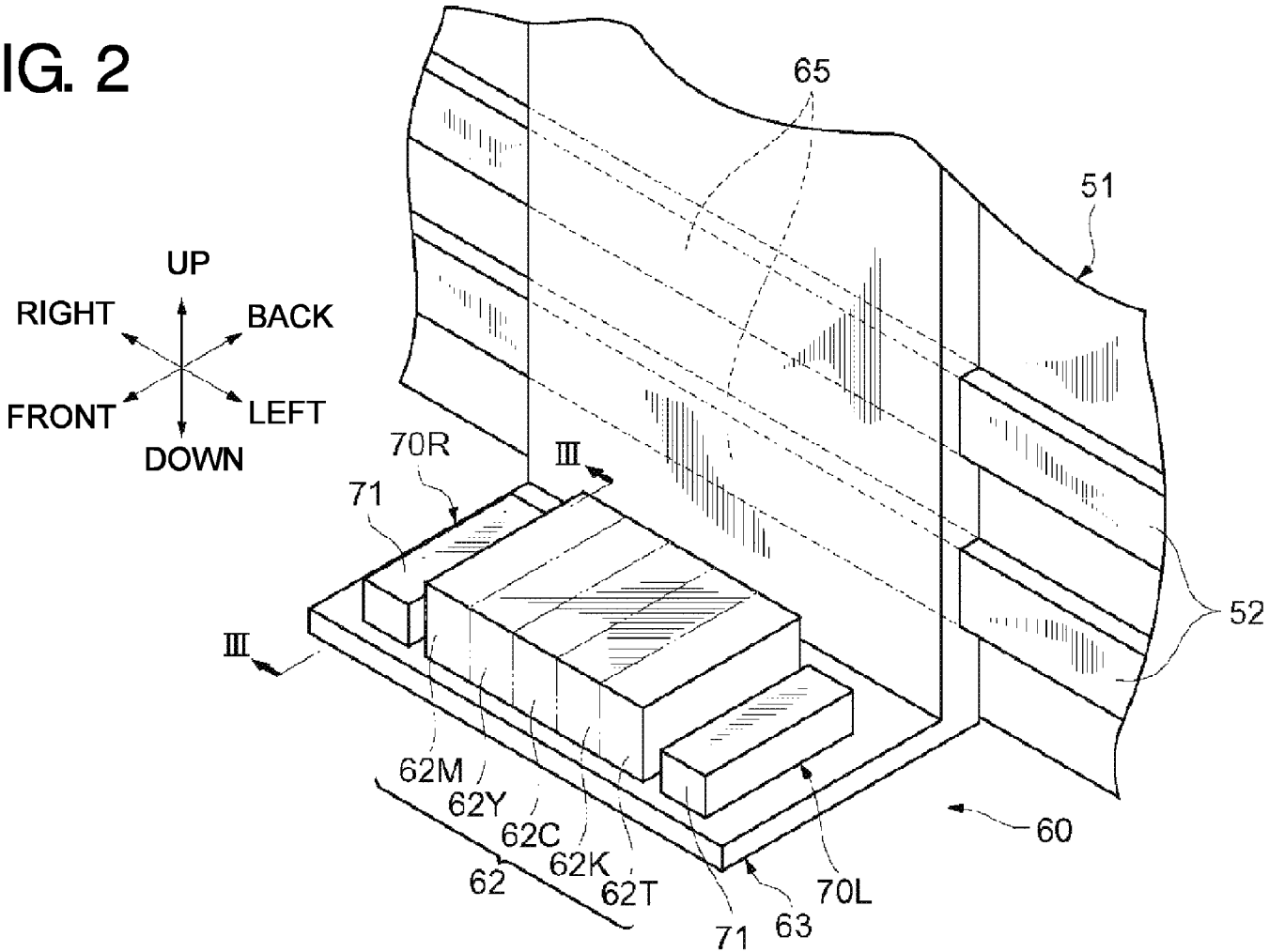
FIG. 2 is a perspective view (some parts are omitted) showing the inside of a print unit.

As shown in FIG. 1 and FIG. 2, the print unit 60 mainly comprises a print head 62, the carriage 63, and a pair of UVLED units, i.e. a right UVLED unit 70R and a left UVLED unit 70L. The outer peripheries of these components are covered by a cover 61. The print head 62 comprises print heads 62M, 62Y, 62C, 62K, 62T corresponding to respective UV inks of magenta (M), yellow (Y), cyan (C), black (K), and clear (T), respectively. Each of the print heads 62M, 62Y, 62C, 62K, 62T has a plurality of nozzles (not shown) capable of ejecting UV ink downwardly which are formed in the bottom surface thereof, and is fixed to the carriage 63 such that the bottom surface is spaced apart from the print medium 2 by a predetermined gap. On the upper surface of a left end portion of the base portion 51, ink storage tanks 53M, 53Y, 53C, 53K, 53T for the respective colors are fixed. The ink storage tanks are connected to the print heads 62 corresponding to the colors via pipe lines (not shown) so that the UV ink is sent from the ink storage tank 53 to the print head 62.

The UV ink is an ink of a type that it is cured by irradiation with ultraviolet light. The curing degree depends on the amount of ultraviolet light. When the UV ink is irradiated with a small amount of ultraviolet light, the UV ink is temporarily cured and becomes to a gel state (hereinafter, this phenomenon will be referred to as temporary curing). When the UV ink is further irradiated with an increased amount of ultraviolet light, the UV ink is completely cured (hereinafter, this phenomenon will be referred to as final curing).

The carriage 63 is a mounting base for the print head 62, the right UVLED unit 70R and the left UVLED unit 70L and is supported by that the left-right guides 65 formed in the back surface thereof are fitted into the guide rails 52 so that the carriage 63 can freely slide in the left-right direction. The carriage 63 is moved in the left-right direction (Y-axis direction) by a leftward-rightward driving mechanism 69 in the state mounted with the print head 62, the right UVLED unit 70R and the left UVLED unit 70L thereon. As the leftward-rightward driving mechanism 69, driving mechanisms of various kinds may be employed similarly to the forward-backward driving mechanism 59. For example, the leftward-rightward driving mechanism 69 may be composed of a driving pulley and a driven pulley (timing pulley) which are rotatably disposed on the left end and the right end of the base portion 51, respectively, a servo motor for rotating the driving pulleys, and an endless belt (timing belt) which is laid to extend around and between the driving pulley and the driven pulley with some tension. The carriage 63 is fixed to a middle portion of the driving belt (the timing belt). The leftward-rightward driving mechanism 69 moves the carriage 63 at a moving speed and in a direction, i.e. the leftward or rightward direction, corresponding to an operational signal outputted from the controller 23 as will be described later.

Figure 3A:
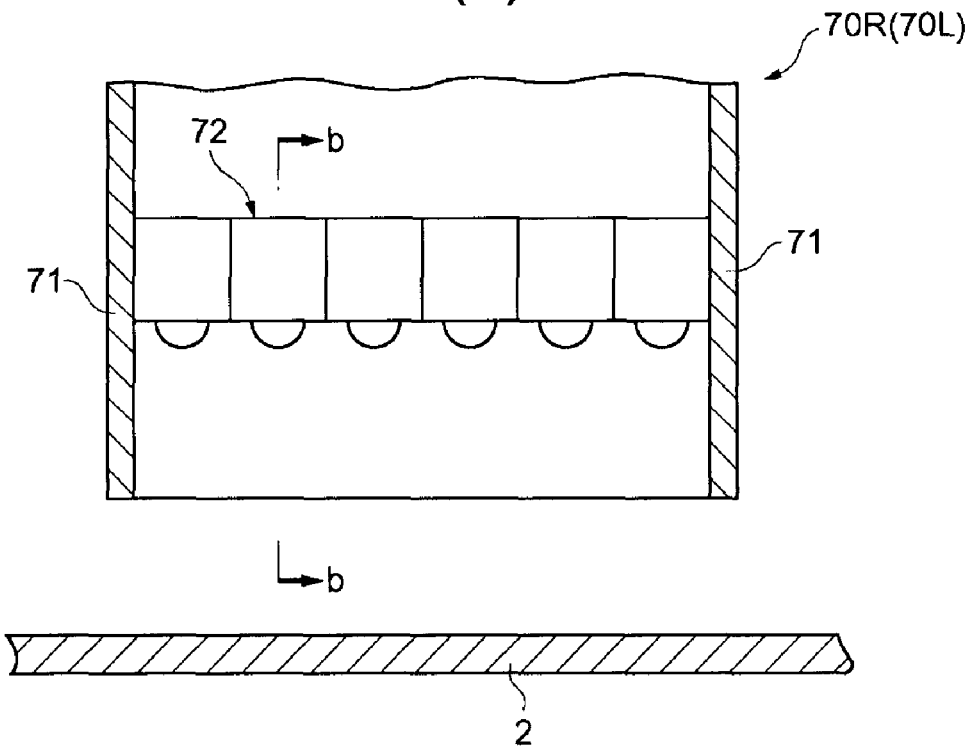
FIGS. 3(*a*) and 3(*b*) are sectional view showing the structure of the UVLED unit, wherein FIG. 3(*a*) is a sectional view taken along a line III-III in FIG. 2 and FIG. 3(*b*) is a sectional view taken along a line b-b in FIG. 3(*a*)
Figure 3B:
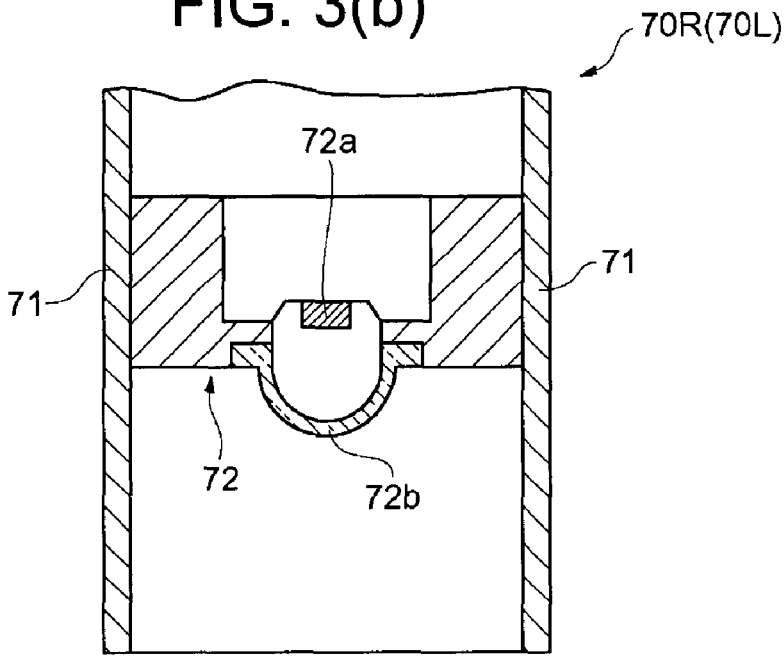

The right UVLED unit 70R and the left UVLED unit 70L are paired and are each composed of a casing 71 and a plurality of UVLEDs 72 as shown in FIG. 2 and FIGS. 3(*a*), 3(*b*). The plurality of UVLEDs 72 are aligned in the casing 71 formed in a rectangular box shape having an opening formed the bottom thereof such that the UVLEDs 72 are capable of emitting ultraviolet light downwardly. The right UVLED unit 70R and the left UVLED unit 70L are disposed on the both sides of the print head 62 and are fixed to and supported by the carriage 63. As for the UVLEDs 72, various arrangements may be considered and a suitable arrangement among them is employed. In this embodiment, a unit arrangement is employed in which six UVLEDs 72 are accommodated in the casing 71 in the state aligned linearly in the anteroposterior direction.

Each UVLED 72 is mainly composed of a UVLED chip 72*a* for emitting ultraviolet light and a condenser lens 72*b*. Ultraviolet light emitted from the UVLED chip 72*a* is collected by the condenser lens 72*b* so as to have a predetermined irradiation angle so that the ultraviolet light is emitted downwardly from the opening formed in the bottom of the casing 71. The current value of the supply current for the UVLED chip 72*a* is controlled by the controller 23 as will be described later, whereby the UVLED chip 72*a* can be instantaneously switched OFF or ON and/or can emit ultraviolet light of a strength corresponding to the current value.

The control unit 20 is disposed on a front end of the supporting table 12 and mainly comprises an operation panel 21, a stop button 22, and a controller 23. The operation panel 21 is provided with a numeric keyboard and/or a function keyboard (not shown) for imputing/selecting various information such as the kind of print medium 2, the kind of UV inks, the printing pattern, and the curing mode, a display panel (not shown) for displaying a window for allowing the input/selection or confirmation of the various information. The stop button 22 is a button which when it is pressed, a signal is inputted into the controller 23 so as to stop the operation of the inkjet printer 1.

The "printing pattern" indicates the print quality required by an operator and means, for example, a combination of resolution indicated by dpi and the number of passes (the number of times the print head 62 passes the same point on the print medium 2). Generally, as the resolution and the number of passes are larger, the time required for printing is longer while the print quality is better. The "curing mode" includes a two-stage curing mode in which uncured UV ink is temporarily cured and is then finally cured and a single-stage curing mode in which uncured UV ink is finally cured without temporary curing and can be selected according to the print quality and the print speed required by an operator. For example, when the higher print quality is desired rather than the print speed so that the resolution and the number of passes are set to be larger, the two-stage curing mode is selected. On the other hand, when the higher print speed is desired rather than the print quality so that the number of passes is set to be smaller, the single-stage curing mode is selected.

The controller 23 is a control device for controlling the operation of the entire apparatus including the respective mechanisms of the inkjet printer 1. The controller 23 is adapted to control the printing on the print medium 2 fixed and held by the supporting table 12 by conducting the pressure control for controlling the pressure of the decompression chamber by the vacuum blower 13, the forward and backward movement control for controlling the forward and backward movement of the base portion 51 by the forward-backward driving mechanism 59, the leftward and rightward movement control for controlling the leftward and rightward movement of the carriage 63 by the leftward-rightward driving mechanism 69, the ink ejection control for controlling the ink ejection from the print head 62, and the irradiation intensity control for controlling the irradiation intensity of ultraviolet light emitted from the right UVLED unit 70R and the left UVLED unit 70L (UVLED 72). Into the controller 23, respective information such as the kind of the print medium 2, the kind of UV ink, the printing pattern, and the curing mode are inputted via the operation panel 21.

The method for printing on a white print medium 2 by using the inkjet printer 1 having the aforementioned structure and the control procedure by the controller 23 will be described below. It should be noted that the illustrated embodiment is an example in which before the start of the printing, the print unit 60 is positioned at a position (hereinafter, referred to as "home position") on a left side of the left end of the print medium 2 as shown in FIG. 4(*a*) and FIG. 9(*a*) so that UV ink can be deposited even onto the left and right ends of the surface of the print medium 2 (without margins).

The printing in the two-stage curing mode will be described with reference to FIG. 4(*a*) through FIG. 8 will be described. At step S1, the print medium 2 is placed at the original position on the vacuum table 12*a* and is vacuumed and adsorbed onto the vacuum table 12*a*. The operator inputs various information such as the kind of the print medium 2 to be printed, the kind of UV ink to be used in printing, the printing pattern, and the curing mode into the controller 23 via the operation panel 21 or the like. Based on the information inputted such as the kind of the print medium 2, the kind of the UV ink, and the printing pattern, the controller 23 determines, according to the image data to be printed, the moving speed (hereinafter, referred to as "first scan speed $V_1$") of the print unit 60 (the print head 62, the right UVLED unit 70R and the left UVLED unit 70L mounted on the carriage 63) moving in the leftward-rightward direction, and the ejection pattern of UV ink to be ejected from the print head 62 while the print unit 60 is moving in the leftward-rightward direction. In addition, the operator selects the two-stage curing mode as the curing mode.

At step S2, the controller 23 determines a first ultraviolet light quantity $L_1$ for temporarily curing the UV ink and a second ultraviolet light quantity $L_2$ for finally curing the UV ink based on the information of the kind of the UV ink inputted at step S1. Based on the first ultraviolet light quantity $L_1$, the controller determines a first irradiation intensity $I_1$ of the left UVLED unit 70L (the right UVLED unit 70R) required for temporarily curing the UV ink ejected from the print head 62 and deposited on the print medium 2 while the print unit 60 (the right UVLED unit 70R and the left UVLED unit 70L) moves at the first scan speed $V_1$.

Figure 4A:
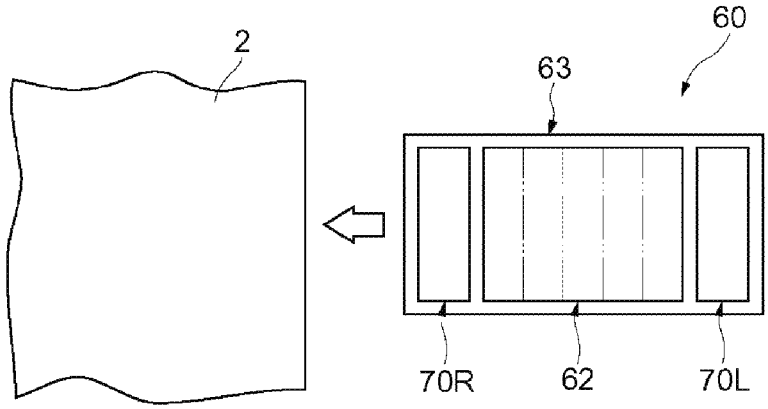
FIGS. 4(*a*)-4(*c*) are explanatory illustrations for explaining the control of ink ejection and the control of irradiation with ultraviolet light for depositing UV ink onto a surface of a print medium in the two-stage curing mode.
Figure 4B:
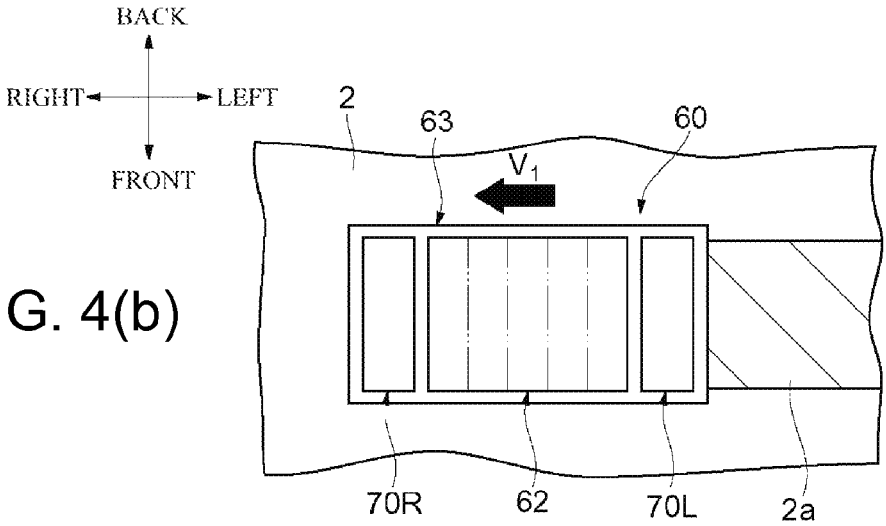
Figure 4C:
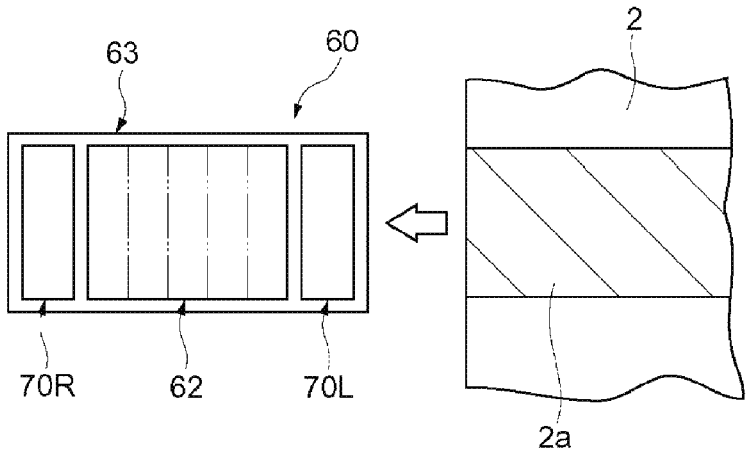
Figure 5A:
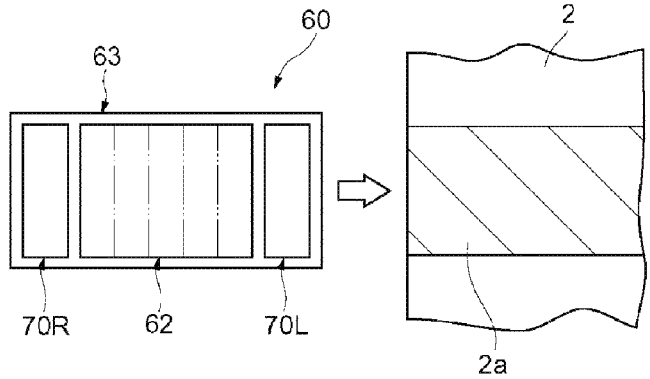
FIGS. 5(*a*)-5(*c*) are explanatory illustrations for explaining the control of ink ejection and the control of irradiation with ultraviolet light for depositing UV ink onto the temporarily cured UV ink in the two-stage curing mode.
Figure 5A:
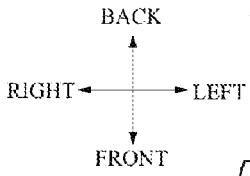
Figure 5B:
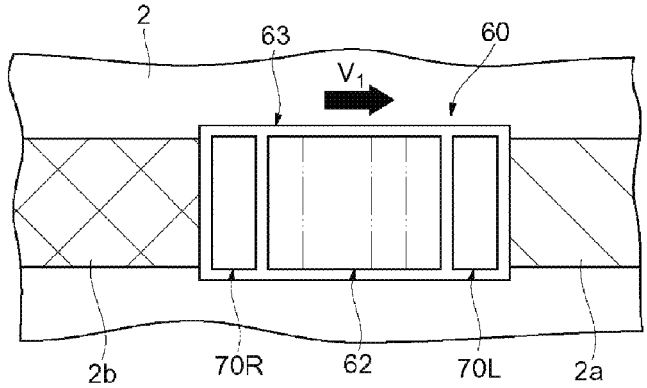
Figure 5C:
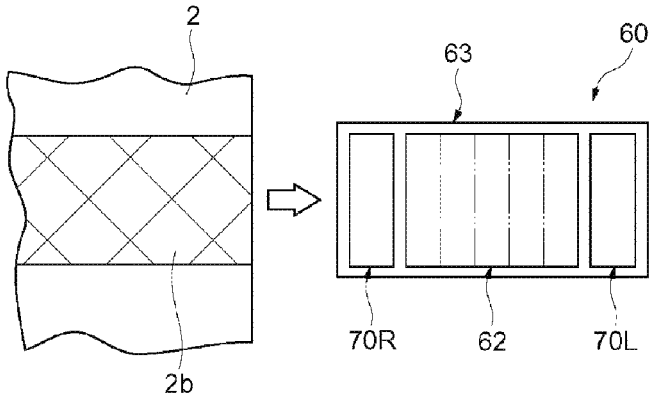
Figure 6A:
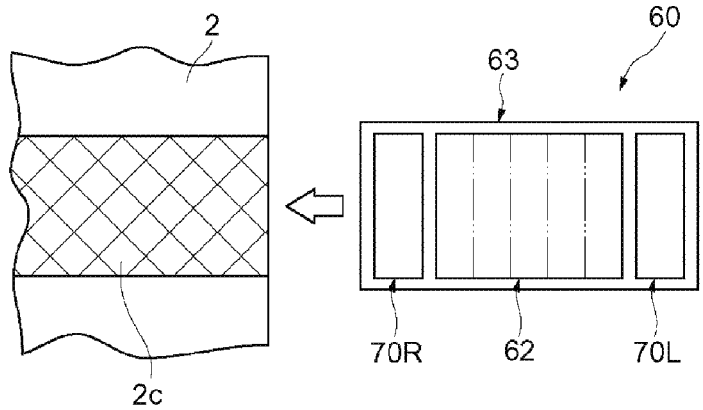
FIGS. 6(*a*)-6(*c*) are explanatory illustrations for explaining the control of irradiation with ultraviolet light for finally curing the temporarily cured UV inks in the two-stage curing mode.
Figure 6A:
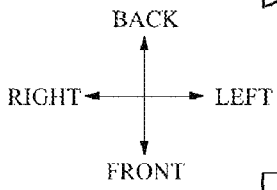
Figure 6B:
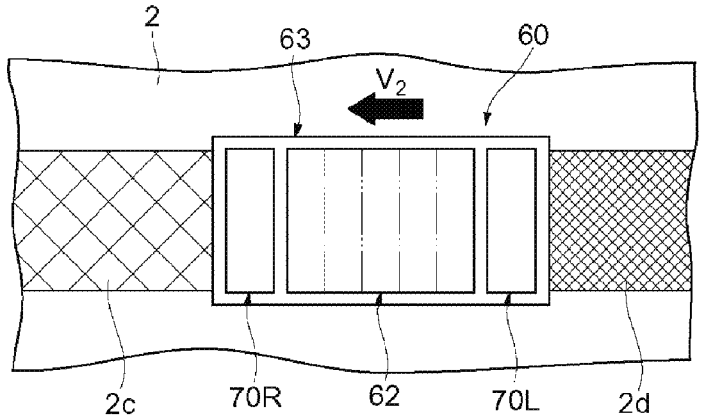
Figure 6C:
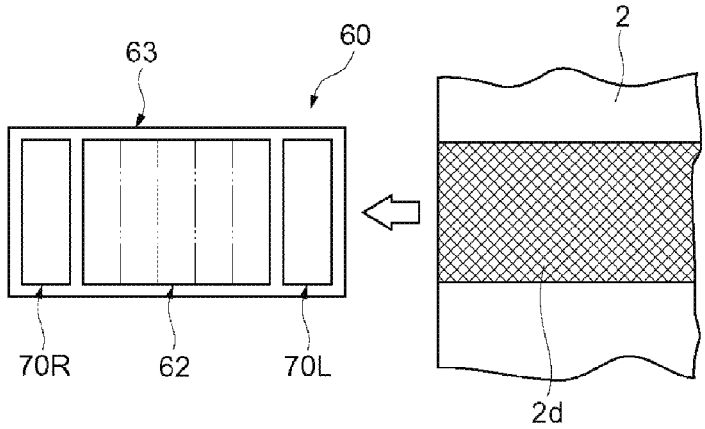
Figure 7A:
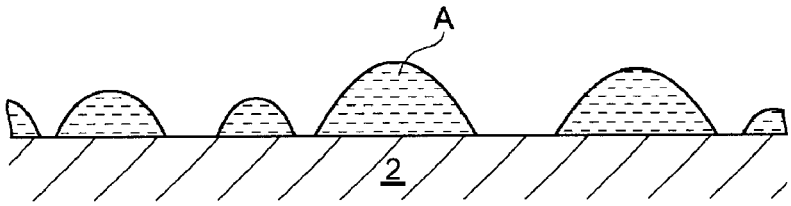
FIG. 7(*a*) is a sectional view showing ink droplets just after deposited on the print medium and temporarily cured, FIG. 7(*b*) is a sectional view showing the ink droplets shown in FIG. 7(*a*) but leveled over time, FIG. 7(*c*) is a sectional view showing ink droplets just after deposited on the temporarily cured ink droplets and temporarily cured, and FIG. 7(*d*) is a sectional view showing the ink droplets shown in FIG. 7(*c*) but leveled over time.
Figure 7B:
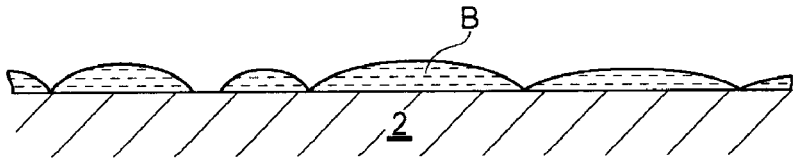
Figure 7C:
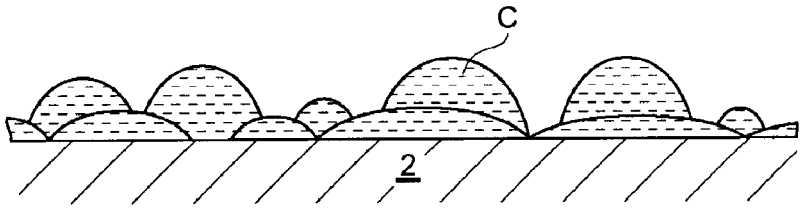
Figure 7D:
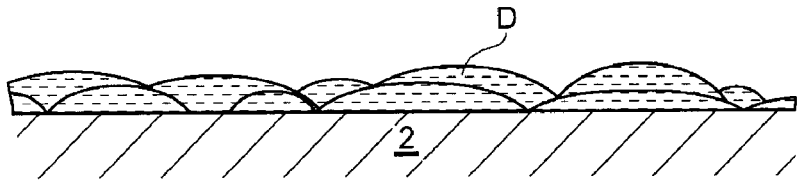

At step S3, the irradiation intensity of the left UVLED unit 70L is set to have the first irradiation intensity $I_1$ and the print unit 60 (the carriage 63) is moved in the rightward direction at the first scan speed $V_1$ as shown in FIG. 4(*b*). During this, the UV ink is ejected and deposited onto the print medium 2 in the aforementioned ejection pattern and is temporarily cured by irradiation with ultraviolet light from the left UVLED unit 70L. As the print unit 60 is moved from the home position to a position (hereinafter, referred to as "reverse position") which is on the right side of the right end of the print medium 2, a first printed line 2*a* is formed which extends in the leftward-rightward direction in the state that the UV ink is deposited on the surface of the print medium 2 and is temporarily cured, that is, the action for the first pass is terminated (see FIG. 4(*c*)).

Since the right UVLED unit 70R is positioned on the right side of the print head 62, the right UVLED unit 70R is about to emit ultraviolet light to the print medium 2 without UV ink deposited when the print unit 60 moves in the rightward direction. Therefore, at step S3, the right UVLED unit 70R is preferably controlled to be, for example, the OFF state (irradiation intensity=0) so as to emit no ultraviolet light. Alternatively, a shutter mechanism may be provided between the print medium 2 and the right UVLED unit 70R (the UVLEDs 72). In this case, the shutter mechanism is controlled so as to block the ultraviolet light irradiation.

Since the UV ink forming the first printed line 2*a* is in the gel state because of the temporary curing, ink droplets B (see FIG. 7(*b*)) of the UV ink at this point are leveler than ink droplets A (see FIG. 7(*a*)) which are ejected from the print head 62 and deposited on the surface of the print medium 2 and which are immediately after temporary curing because the ink droplets B are leveled over time until irradiated with ultraviolet light for finally curing as will be described later. In addition, the ink droplets B are not mixed with the adjacent ones even though these are superposed.

At step S4, the right UVLED unit 70R is set to have the first irradiation intensity $I_1$ in a state that the print unit 60 is positioned at the reverse position as shown in FIG. 5(*a*) after the action for the first pass is terminated at step S3. Since the left UVLED unit 70L is positioned on the left side of the print head 62, the left UVLED unit 70L is about to emit ultraviolet light to the first printed line 2*a* so as to promote further curing when the print unit 60 moves in the leftward direction. Therefore, at step S4, the left UVLED unit 70L is preferably controlled to be, for example, the OFF state (irradiation intensity=0) so as to emit no ultraviolet light. Alternatively, similarly to the aforementioned right UVLED unit 70R, a shutter mechanism may be provided between the print medium 2 and the left UVLED unit 70L (the UVLEDs 72). In this case, the shutter mechanism is controlled so as to block the ultraviolet light irradiation.

At step S5, the print unit 60 (the carriage 63) is moved in the leftward direction at the first scan speed $V_1$ as shown in FIG. 5(*b*) after the irradiation intensity of the right UVLED unit 70R and the irradiation intensity of the left UVLED unit 70L are set at step S4. During this, UV ink is emitted from the print head 62 in the aforementioned ejection pattern and is deposited on the first printed line 2*a* (the UV ink in the gel state which is deposited on the print medium 2 and is temporarily cured). Further, the UV ink on the first printed line 2*a* is irradiated with ultraviolet light from the right UVLED unit 70R so that the UV ink is temporarily cured. As the print unit 60 is moved from the reverse position to the home position, the later UV ink in the temporarily cured state is deposited on the prior temporarily cured UV ink forming the first printed line 2*a* so as to form a second printed line 2*b*, that is, the action for the second pass is terminated (see FIG. 5(*c*)).

Since the UV ink (later UV ink) deposited on the first printed line 2*a* is temporarily cured in the state deposited on the prior UV ink, which was temporarily cured and is thus in the gel state and leveled, ink droplets adjacent to and superposed on the prior ink droplets are not mixed with the prior ink droplets and thus do not bleed and, further, the later UV ink is not rejected by the prior UV ink. Ink droplets D (see FIG. 7(*d*)) of the UV ink at this point are leveler than ink droplets C (see FIG. 7(*c*)) which are ejected from the print head 62 and deposited on the prior UV ink droplets and which are immediately after temporary curing because the ink droplets D are leveled over time until irradiated with ultraviolet light for finally curing as will be described later.

At step S6, the steps S3 through S5 are repeated according to the number of passes in the printing pattern inputted at step S1, the UV inks in the temporarily cured states are deposited in layers, of which number corresponds to the number of passes (the UV inks are superposed), so as to form a third printed line 2*c* extending in the leftward-rightward direction of the print medium 2 (see FIG. 6(*a*)). As the last action for forming the third printed line 2*c*, transparent clear UV ink is ejected from the print head 62T and deposited and is temporarily cured by irradiation with ultraviolet light from the right UVLED unit 70R or the left UVLED unit 70L, thereby forming a clear coating layer in the temporarily cured state on the surface of the third printed line 2*c*. After the third printed line 2*c* is formed on the surface of the print medium 2, the print unit 60 is positioned at the home position or the reverse position, which depends on the aforementioned number of passes. The following description will be made as regard to a case in which the print unit 60 is positioned at the home position.

At step S7, based on the second ultraviolet light quantity $L_2$, the controller determines a second scan speed $V_2$ of the print unit 60 (the UVLED unit 70R, 70L) required for finally curing the printed line 2*c* (temporarily cured UV inks) and a second irradiation intensity $I_2$ of the right UVLED unit 70R (left UVLED unit 70L). By adjusting the first scan speed $V_1$ of the print unit 60 while maintaining the first irradiation intensity $I_1$ of the right UVLED unit 70R (the left UVLED unit 70L) or by adjusting the first irradiation intensity $I_1$ of the right UVLED unit 70R (the left UVLED unit 70L) while maintaining the first scan speed $V_1$ of the print unit 60 (that is, by adjusting either one of the first irradiation intensity $I_1$ and the first scan speed $V_1$), the controller 23 determines the second scan speed $V_2$ and the second irradiation intensity $I_2$. It should be understood that the controller 23 may determines the second scan speed $V_2$ and the second irradiation intensity $I_2$ by adjusting both the first irradiation intensity $I_1$ of the right UVLED unit 70R (the left UVLED unit 70L) and the first scan speed $V_1$ of the print unit 60.

Here, a method for determining the second scan speed $V_2$ of the print unit 60 and the second irradiation intensity $I_2$ ($I_2=I_1$) of the right UVLED unit 70R (the left UVLED unit 70L) for finally curing the third printed line 2*c* by adjusting the first scan speed $V_1$ of the print unit 60 while maintaining the first irradiation intensity $I_1$ of the right UVLED unit 70R (the left UVLED unit 70L) will be described with reference to FIG. 8.

Figure 8:
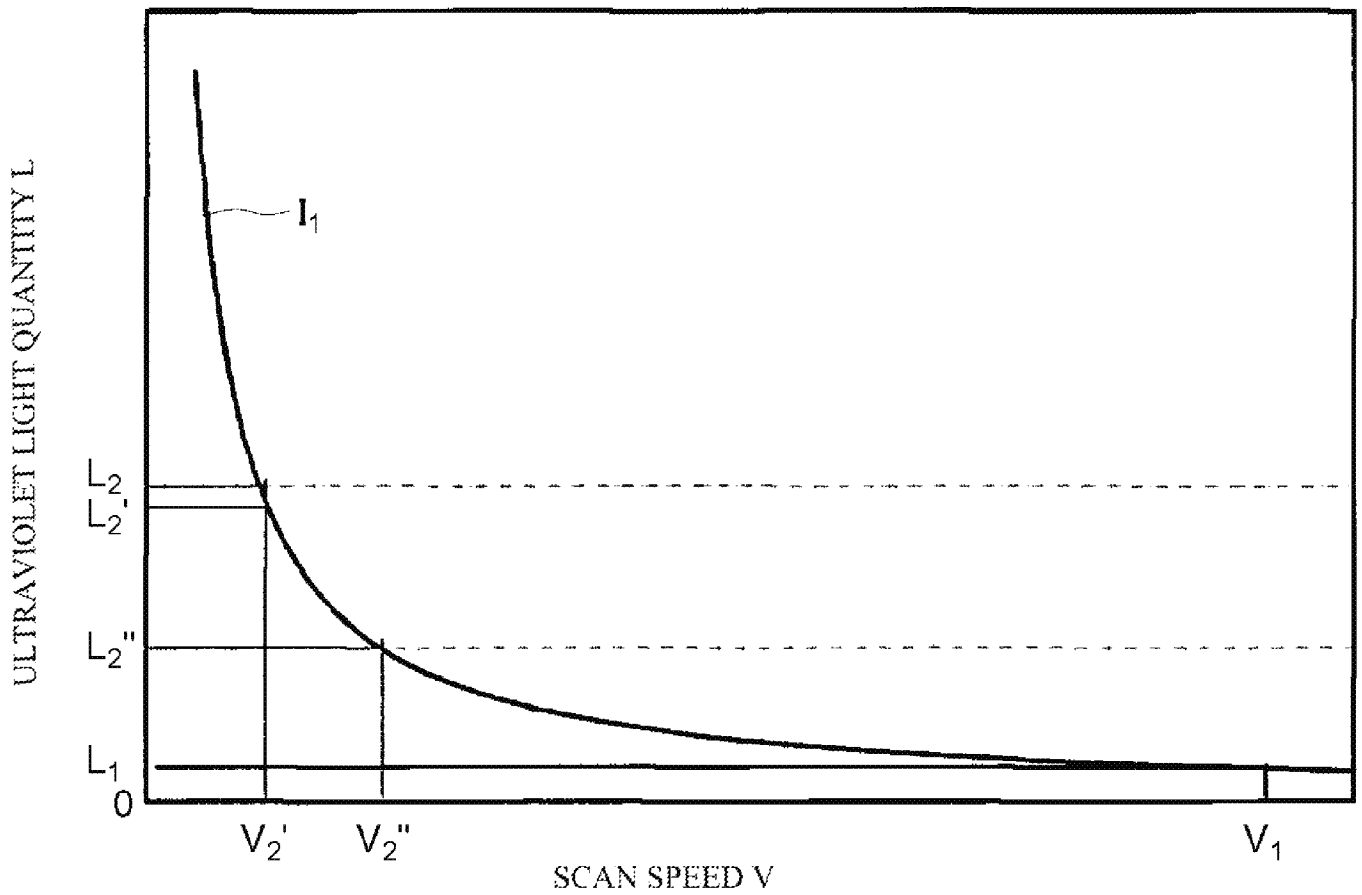
FIG. 8 is a graph showing a relationship between the scan speed of the UVLED unit and the ultraviolet light quantity irradiating the UV inks deposited on the print medium.

FIG. 8 shows a relationship between the scan speed V of the print unit 60 (the right UVLED unit 70R and the left UVLED unit 70L) and the ultraviolet light quantity L irradiating the UV inks deposited on the print medium 2 when the irradiation intensity of the right UVLED unit 70R (the left UVLED unit 70L) is set to the first irradiation intensity $I_1$, in which the larger the scan speed V is, the smaller the ultraviolet light quantity L is (that is, there is an inverse relationship between the scan speed V and the ultraviolet light quantity L). As for the second ultraviolet light quantity $L_2$ required for finally curing the UV ink which is determined at step S2, the third ultraviolet light quantity $L_{2'}$ required for finally curing the third printed line 2*c* is $L_{2'}=(L_2-L_1)$ because the third printed line 2*c* was irradiated with at least ultraviolet light of the first ultraviolet light quantity $L_1$ until step S6 so that the third printed line 2*c* is in the temporarily cured state. Therefore, when the second irradiation intensity $I_2$ of the right UVLED unit 70R (the left UVLED unit 70L) is $I_2=I_1$, the second scan speed $V_2$ of the print unit 60 (the right UVLED unit 70R and the left UVLED unit 70L) required for finally curing the third printed line 2*c* is determined to be $V_2=V_{2'}$.

The right UVLED unit 70R and the left UVLED unit 70L may be both turn ON for finally curing the printed line 2*c*. Therefore, when the irradiation intensity of the right UVLED unit 70R and the irradiation intensity of the left UVLED unit 70L are both set to the first irradiation intensity $I_1$, the right UVLED unit 70R and the left UVLED unit 70L may be each set to emit ultraviolet light of half of the third ultraviolet light quantity $L_{2'}$ (the fourth ultraviolet light quantity $L_{2''}$). Accordingly, when the irradiation intensity of the right UVLED unit 70R and the irradiation intensity of the left UVLED unit 70L are set to the first irradiation intensity $I_1$, the second scan speed $V_2$ of the print unit 60 (the right UVLED unit 70R and the left UVLED unit 70L) required for finally curing the third printed line 2*c* is determined to be $V_2=V_{2''}$.

At step S8, the irradiation intensity of the right UVLED unit 70R and the irradiation intensity of the left UVLED unit 70L are both set to the first irradiation intensity $I_1$ (the irradiation intensity of the right UVLED unit 70R (the left UVLED unit 70L) is set to the second irradiation intensity $I_2$), and the print unit 60 (the right UVLED unit 70R and the left UVLED unit 70L) is moved in the rightward direction at the second scan speed $V_2$ ($V_2=V_{2''}$) as shown in FIG. 6(*b*). During this, the third printed line 2*c* is finally cured by irradiation with ultraviolet light from the right UVLED unit 70R and the left UVLED unit 70L. As the print unit 60 is moved from the home position to the reverse position in this manner, the third printed line 2*c* is finally cured in the leveled state, thereby forming a fourth printed line 2*d* fixed to the surface of the print medium 2 (see FIG. 6(*c*)).

At step S9, the print unit 60 is moved in the anteroposterior direction for a distance corresponding to the anteroposterior width of the fourth printed line 2*d*. After that, similarly to the aforementioned steps S3 through S8, UV ink is ejected in the aforementioned ejection pattern from the print head 62 and is deposited on a printed line adjacent to the fourth printed line 2*d*. In addition, the UV ink deposited on the print medium 2 is temporarily cured by the left UVLED unit 70L or the right UVLED unit 70R, thereby forming a first printed line 2*a*. Then, the respective UV inks in the temporarily cured state are deposited in layers, of which number corresponds to the number of passes, so as to form a third printed line 2*c*. The third printed line 2*c* in the leveled state is finally cured by the right UVLED unit 70R and the left UVLED unit 70L so as to form a fourth printed line 2*d* fixed to the print medium 2. In this manner, the deposition, the temporary curing, and the final curing of UV inks are repeated on the surface of the print medium 2 several times corresponding to the number of printed lines according to the image data. Then, the printing in the two-stage curing mode is terminated.

Hereinafter, the printing in the single-stage curing mode will be described with reference to FIG. 9 and FIG. 10. It should be understood that the single-stage curing mode is selected when the higher print speed is desired rather than the print quality as compared to the aforementioned two-stage curing mode. Here, description will be made with regard to a case that single pass printing is conducted for printing, for example, image data (characters) of single color or with less shading and that is a suitable case for the printing in the single-stage curing mode.

At step S1', similarly to the aforementioned two-stage curing mode, the print medium 2 is placed on the original position on the vacuum table 12*a* and is vacuumed and adsorbed onto the vacuum table 12*a* so that the print medium 2 is fixed and held. The operator inputs various information such as the kind of the print medium 2 to be printed, the kind of UV ink to be used in printing, the printing pattern, and the curing mode into the controller 23 via the operation panel 21 or the like. Based on the information inputted such as the kind of the print medium 2, the kind of the UV ink, and the printing pattern, the controller 23 determines, according to the image data to be printed, a third scan speed $V_3$ (the moving speed in the leftward-rightward direction) of the print unit 60 (the print head 62, the right UVLED unit 70R and the left UVLED unit 70L mounted on the carriage 63), and the ejection pattern of UV ink to be ejected from the print head 62 while the print unit 60 is moving in the leftward-rightward direction. In addition, the operator selects the single-stage curing mode as the curing mode.

At step S2', the controller 23 determines a third ultraviolet light quantity $L_3$ for finally curing the UV ink based on the information of the kind of the UV ink inputted at step S1'. Based on the third ultraviolet light quantity $L_3$, the controller determines a third irradiation intensity $I_3$ of the left UVLED unit 70L (the right UVLED unit 70R) required for finally curing the UV ink ejected from the print head 62 and deposited on the print medium 2 while the print unit 60 (the right UVLED unit 70R and the left UVLED unit 70L) moves at the third scan speed $V_3$.

Figure 9A:
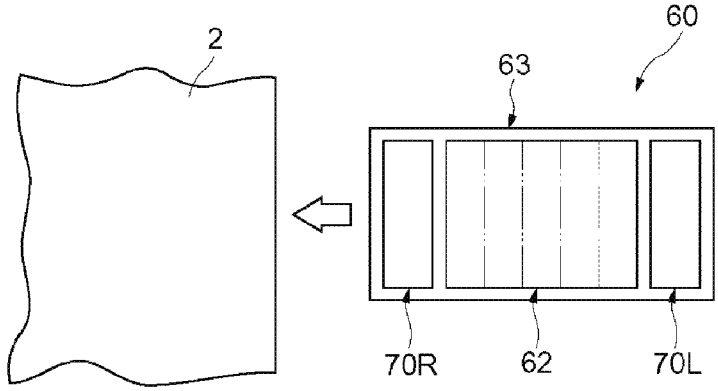
FIGS. 9(*a*)-9(*c*) are explanatory illustrations for explaining the control of ink ejection and the control of irradiation with ultraviolet light for depositing UV ink onto a surface of a print medium to form a prior printed line in the single-stage curing mode.
Figure 9B:
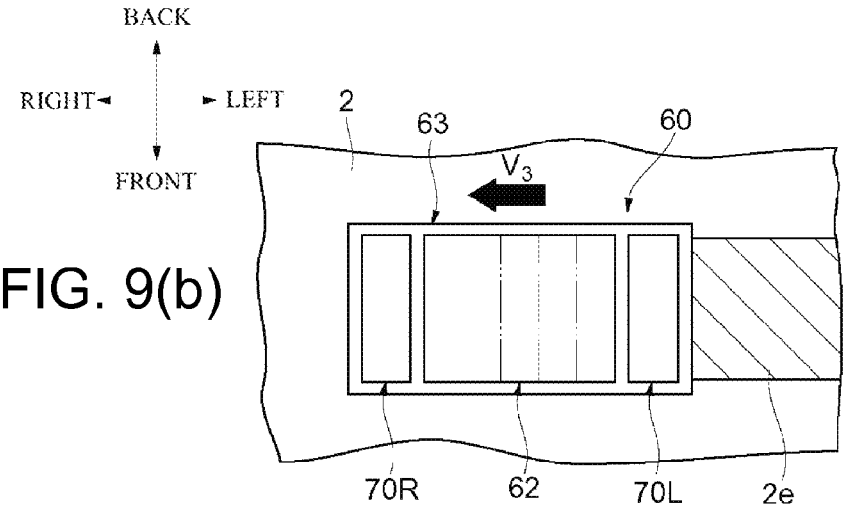
Figure 9C:
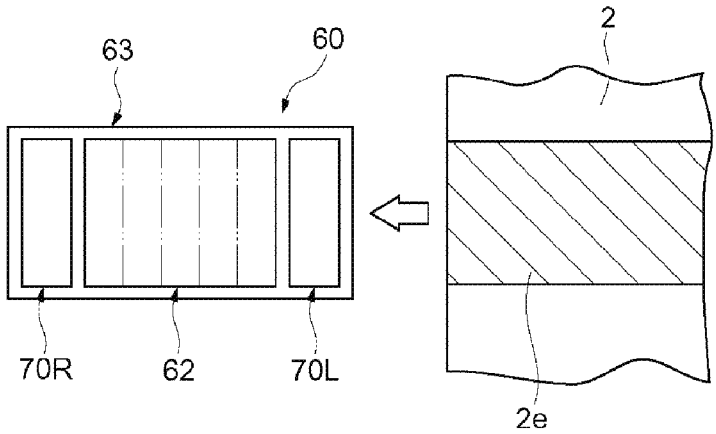
Figure 10A:
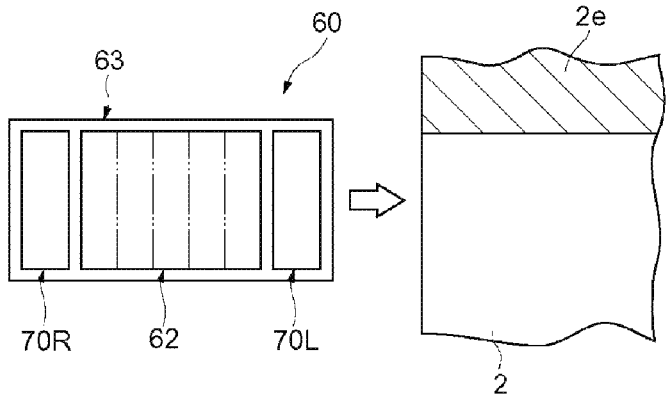
FIGS. 10(*a*)-10(*c*) are explanatory illustrations for explaining the control of ink ejection and the control of irradiation with ultraviolet light for depositing UV ink on a line adjacent to the prior printed line to form a later printed line in the single-stage curing mode.
Figure 10A:
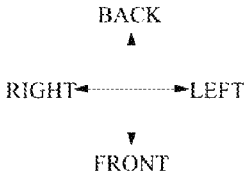
Figure 10B:
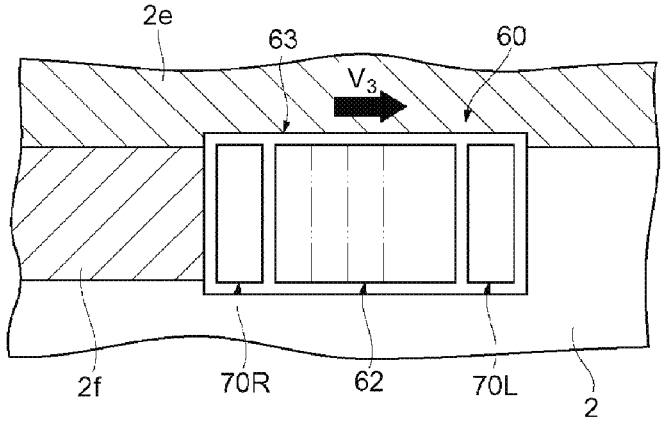
Figure 10C:
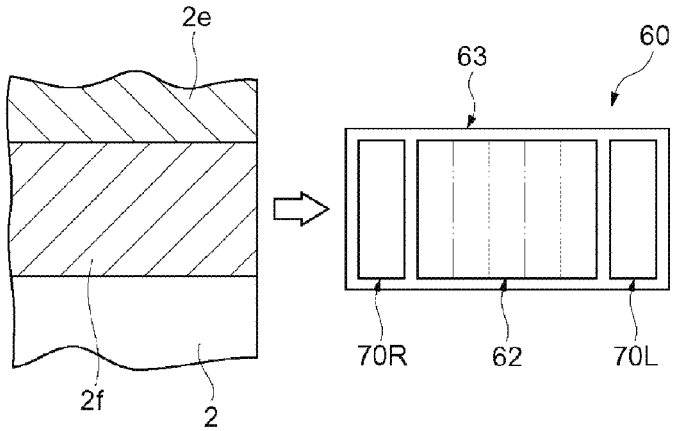
Figure 11A:
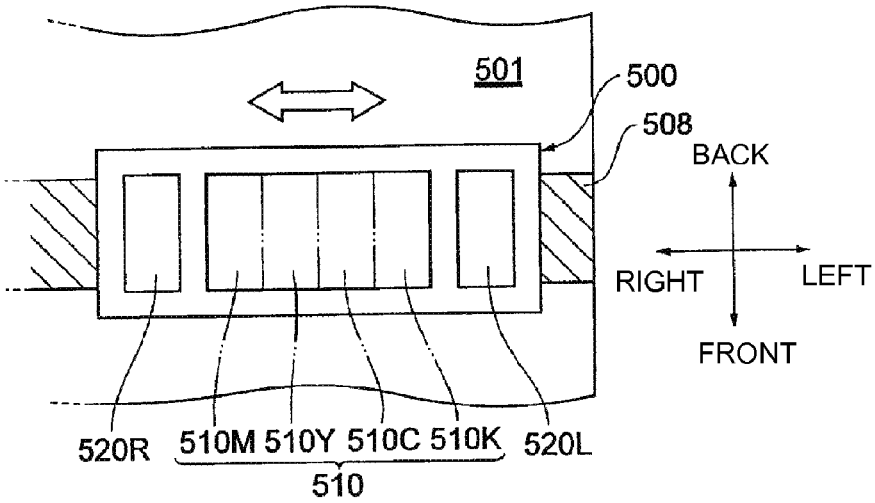
FIG. 11(*a*) is a top view showing a conventional print unit, FIG. 11(*b*) is a sectional view showing a state that ink droplets are deposited on completely cured ink droplets, and FIG. 11(*c*) is a sectional view showing a state that ink droplets are deposited on uncured ink droplets.
Figure 11B:
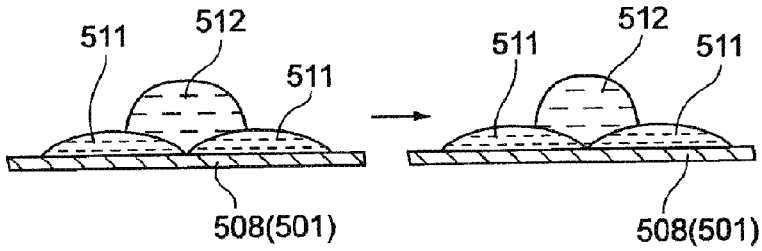
Figure 11C:
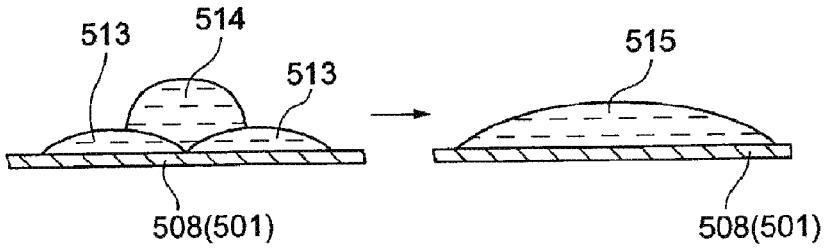

At step S3', the irradiation intensity of the left UVLED unit 70L is set to the third irradiation intensity $I_3$ and the print unit 60 (the carriage 63) is moved in the rightward direction at the third scan speed $V_3$ as shown in FIG. 9(*b*). During this, the UV ink is ejected and deposited onto the print medium 2 in the aforementioned ejection pattern and is finally cured by irradiation with ultraviolet light from the left UVLED unit 70L. As the print unit 60 is moved from the home position to the reverse position, a fifth printed line 2*e* is formed which extends in the leftward-rightward direction in the state that the UV ink is deposited on the surface of the print medium 2 and is finally cured (see FIG. 9(*c*)).

Since the right UVLED unit 70R is positioned on the right side of the print head 62, the right UVLED unit 70R is about to emit ultraviolet light to the print medium 2 without UV ink deposited when the print unit 60 moves in the rightward direction. Therefore, similarly to the aforementioned printing in the two-stage curing mode, at step S3, the right UVLED unit 70R is preferably controlled to be, for example, the OFF state (irradiation intensity=0) so as to emit no ultraviolet light. Alternatively, a shutter mechanism may be provided so that the shutter mechanism is controlled so as to block the ultraviolet light irradiation.

At step S4', after the fifth printed line 2*e* is formed at step S3', the print unit 60 is moved in the anteroposterior direction for a distance corresponding to the anteroposterior width of the fifth printed line 2*e* as shown in FIG. 10(*a*) (FIGS. 10(*a*)-(*c*) show a case that the print unit 60 is moved in the forward direction) and the irradiation intensity of the right UVLED unit 70R is set to the third irradiation intensity $I_3$ when the print unit 60 is positioned at the reverse position. Since the left UVLED unit 70L is positioned on the left side of the print head 62, the left UVLED unit 70L is about to emit ultraviolet light to the print medium 2 without UV ink deposited when the print unit 60 moves in the leftward direction. Therefore, similarly to the aforementioned right UVLED unit 70R, the left UVLED unit 70L is preferably controlled to be, for example, the OFF state (irradiation intensity=0) so as to emit no ultraviolet light. Alternatively, a shutter mechanism may be provided so that the shutter mechanism is controlled so as to block the ultraviolet light irradiation.

At step S5', after setting the irradiation intensities of the right UVLED unit 70R and the left UVLED unit 70L, the print unit 60 (the carriage 63) is moved in the leftward direction at the third scan speed $V_3$ as shown in FIG. 10(*b*). During this, UV ink is ejected in the aforementioned ejection pattern from the print head 62 and is deposited on a printed line adjacent to the fifth printed line 2*e*. In addition, the UV ink deposited on the printed line adjacent to the fifth printed line 2*e* is finally cured by irradiation with ultraviolet light from the right UVLED unit 70R. As the print unit 60 is moved from the reverse position to the home position, a sixth printed line 2*f* is formed in the state that the UV ink is deposited on the printed line adjacent to the fifth printed line 2*e* and is finally cured (see FIG. 10(*c*)).

At step S6', similarly to the aforementioned steps S3' through S5', UV ink is ejected in the aforementioned ejection pattern from the print head 62 and is deposited on the print medium 2, and the UV ink deposited on the print medium 2 is finally cured by irradiation with ultraviolet light from the left UVLED unit 70L or the right UVLED unit 70R, thereby forming the fifth printed line 2*e* and the sixth printed line 2*f*. In this manner, the deposition and the final curing of UV ink are repeated on the surface of the print medium 2 several times according to the image data. Then, the printing in the single-stage curing mode is terminated.

Now, major effects by the inkjet printer 1 are summarized as follows. First, when printing in the two-stage curing mode, UV inks deposited on the print medium 2 are temporarily cured so that the UV inks superposed on the surface of the print medium 2 can gradually spread and can be leveled because of good affinity of the UV inks. During this, the UV inks are not mixed and thus do not bleed. Therefore, the temporarily cured UV inks can be superposed in the leveled state without bleeding. Therefore, UV inks can be superposed on the surface of the print medium 2 in the leveled state without bleeding because the UV inks are temporarily cured, and can be fixed to the print medium 2 because the UV inks are finally cured by irradiation with ultraviolet light for final curing, thereby improving the printing quality. In addition, the UV inks gradually spread and are thus leveled over time after being temporarily cured, but do not spread after a certain level and are kept in the leveled state. Therefore, the irradiation with ultraviolet light for finally curing is conducted anytime after the UV inks are leveled, thereby facilitating the control of the irradiation timing of ultraviolet light for final curing.

Secondly, when printing in the two-stage curing mode, the UV inks deposited on the print medium 2 are irradiated with ultraviolet light for temporary curing so that the UV inks become to a gel state, i.e. the temporarily cured state. After that, the UV inks are irradiated with ultraviolet light for final curing so that the UV inks are completely cured and fixed to the print medium 2. By fixing the UV inks in this manner, even when using UV inks having contraction feature, the UV inks are cured in stages so as to reduce the affect of contraction feature, as compared to the case that UV inks are completely cured by irradiation with ultraviolet light at one time, thereby improving the print quality.

Thirdly, when printing in the single-stage curing mode, uncured UV ink deposited on the print medium 2 is irradiated with ultraviolet light for final curing so that the UV ink is completely cured and is fixed to the print medium 2. As compared to the printing in the two-stage curing mode, the number of passes can be reduced for the action for temporarily curing the uncured UV ink, thereby improving the printing speed rather than the print quality depending on the applications of printed matters.

Fourth, the scan speed of the print unit 60 (the right UVLED unit 70R and the left UVLED unit 70L) and the irradiation intensities of the right UVLED unit 70R and the left UVLED unit 70L are controlled such that the UV inks deposited on the print medium 2 are temporarily cured by irradiation with ultraviolet light for temporary curing for each pass, or such that the UV inks temporarily cured are irradiated with ultraviolet light for final curing and are thus fixed to the print medium. According to the control, the light quantity of ultraviolet light for irradiating the UV inks can be finely adjusted as compared to the case that only the irradiation intensities of the right UVLED unit 70R and the left UVLED unit 70L are controlled, thereby curing the UV inks to more desirable curing degree. Since the UV inks are finally cured after temporarily cured (that is, cured in stages), as compared to the inkjet printer comprising two ultraviolet light irradiation means for temporary curing and the final curing, respectively, only single ultraviolet light irradiation means (one of the right UVLED unit 70R and the left UVLED unit 70L) is enough to cure the UV inks in stages, thereby reducing the apparatus size.

Fifth, as for the first scan speed $V_1$ of the print unit 60 and the first irradiation intensity $I_1$ of the right UVLED unit 70R (the left UVLED unit 70L) for temporarily curing uncured UV inks, the controller 23 determines the second scan speed $V_2$ of the print unit 60 and the second irradiation intensity $I_2$ of the right UVLED unit 70R (the left UVLED unit 70L) for finally curing the temporarily cured UV inks by adjusting the first scan speed $V_1$ with keeping the first irradiation intensity $I_1$ or by adjusting the first irradiation intensity $I_1$ with keeping the first scan speed $V_1$. Accordingly, for finally curing the temporarily cured UV inks, the quantity of ultraviolet light for irradiating the UV inks can be more simply conducted as compared to the case of adjusting both the scan speed of the print unit 60 and the irradiation intensity of the right UVLED unit 70R (the left UVLED unit 70L).

Sixth, since the right UVLED unit 70R (the left UVLED unit 70L) is composed of the UVLEDs 72 and the irradiation intensity of ultraviolet light of the UVLEDs 72 can be changed subserviently by variation in current value of the supply current. Therefore, in response to the control of irradiation intensity including the ON/OFF control, it is possible to irradiate the UV inks with ultraviolet light with very little time lag. In addition, since the UVLEDs 72 are small and lightweight, the influence on the movement accuracy and the moving speed of the print unit 60 (the print head 62) is minimized, thereby improving the print quality and the print speed.

Though the right UVLED unit 70R and the left UVLED unit 70L are paired and fixed to the right and left sides of the print head 62 of the carriage 63 in the aforementioned embodiment, the present invention is not limited to this arrangement. For example, another carriage fitted and supported by the base portion 51 may be provided so that the UVLED unit can move separately from the print head 62.

Though the right UVLED unit 70R and the left UVLED unit 70L are paired and fixed to the right and left sides of the print head 62 for allowing the printing in the both directions in which the print head 62 ejects UV ink while moving in not only the rightward direction but also the leftward direction in the aforementioned embodiment, the present invention is not limited to this arrangement. For example, when the print head 62 is adapted to eject UV ink only while moving in the rightward direction or the leftward direction, an UVLED unit may be disposed only on a back side in the moving direction of the print head 62.

Though the aforementioned embodiment is an arrangement (so-called flat bed arrangement) in which printing is conducted relative to the print medium 2 held on the vacuum table 12*a*, the present invention is not limited to this arrangement. For example, the present invention can be applied to an inkjet printer which further comprises a feeding mechanism and a winding mechanism and in which printing is conducted while feeding a sheet-like print medium.

It should be noted that the exemplary embodiments depicted and described herein set forth the preferred embodiments of the present invention, and are not meant to limit the scope of the claims hereto in any way. Numerous modifications and variations of the present invention are possible in light of the above teachings. It is therefore to be understood that, within the scope of the appended claims, the invention may be practiced otherwise than as specifically described herein.

What is claimed is:

1. An inkjet printer comprising:

medium supporting means for supporting a print medium;

print head means for ejecting ink droplets while moving relative to the print medium so as to print on a surface of the print medium;

ultraviolet light irradiation means for emitting ultraviolet light toward the print medium supported on said medium supporting means to cure the ink droplets deposited on the print medium;

irradiation light quantity control means for adjusting a light quantity of ultraviolet light emitted from said ultraviolet light irradiation means to the ink droplets deposited on the print medium in a range from a light quantity for temporarily curing the ink droplets to a light quantity for finally curing the ink droplets; and mode switching means for selecting between a two-stage curing mode in which UV ink droplets deposited to the print medium are temporarily cured and are then finally cured and a single-stage curing mode in which UV ink droplets are finally cured by an irradiation with ultraviolet light at one time by said ultraviolet light irradiation means and said irradiation light quantity control means.

2. The inkjet printer as claimed in claim 1, further comprising a light source moving means for moving said ultraviolet light irradiation means along and relative to the print medium.

3. The inkjet printer as claimed in claim 2, wherein said irradiation light quantity control means is capable of adjusting the light quantity of ultraviolet light irradiating the ink droplets deposited on the print medium from the light quantity for temporarily curing the ink droplets to the light quantity for finally curing the ink droplets by adjusting at least one of the irradiation intensity by said ultraviolet light irradiation means and a moving speed of said ultraviolet light irradiation means by said light source moving means.

4. The inkjet printer as claimed in claim 3, wherein said ultraviolet light irradiation means comprises light-emitting diodes configured to emit ultraviolet light toward the print medium.

5. The inkjet printer as claimed in claim 1, wherein said ultraviolet light irradiation means comprises light-emitting diodes configured to emit ultraviolet light toward the print medium.

6. An inkjet printer comprising:

a print head arranged to face a print medium supported on a medium support, said print head being configured to eject ink droplets while moving relative to the print medium so as to conduct desired printing on a surface of the print medium;

an ultraviolet light irradiation device configured to emit ultraviolet light toward the print medium supported on the medium support to cure the ink droplets deposited on the print medium;

an irradiation light quantity control device configured to adjust a light quantity of ultraviolet light, emitted from said ultraviolet light irradiation device to the ink droplets deposited on the print medium, from a light quantity for temporarily curing the ink droplets to a light quantity for finally curing the ink droplets; and a mode switching device configured to select between a two-stage curing mode in which UV ink droplets deposited to the print medium are temporarily cured and are then finally cured and a single-stage curing mode in which UV ink droplets are finally cured by an irradiation with ultraviolet light at one time by said ultraviolet light irradiation device and said irradiation light quantity control device.

7. The inkjet printer as claimed in claim 6, further comprising a light source moving device configured to move said ultraviolet light irradiation device along and relative to the print medium.

8. The inkjet printer as claimed in claim 7, wherein said irradiation light quantity control device is capable of adjusting the light quantity of ultraviolet light irradiating the ink droplets deposited on the print medium from the light quantity for temporarily curing the ink droplets to the light quantity for finally curing the ink droplets by adjusting at least one of the irradiation intensity by said ultraviolet light irradiation device and a moving speed of said ultraviolet light irradiation device by said light source moving device.

9. The inkjet printer as claimed in claim 8, wherein said ultraviolet light irradiation device comprises light-emitting diodes configured to emit ultraviolet light toward the print medium.

10. The inkjet printer as claimed in claim 6, wherein said ultraviolet light irradiation device comprises light-emitting diodes configured to emit ultraviolet light toward the print medium.

11. A printing method used in an inkjet printer of a type in which a print head is arranged to face a print medium supported on a medium support, said printing method comprising:

ejecting ink droplets from the print head while moving the print head relative to the print medium so as to conduct desired printing on a surface of the print medium; and emitting ultraviolet light toward the print medium supported on the medium support to cure the ink droplets deposited on the print medium, wherein the emitting of ultraviolet light includes selecting between a two-stage curing mode in which UV ink droplets deposited to the print medium are temporarily cured and are then finally cured and a single-stage curing mode in which UV ink droplets are finally cured by an irradiation with ultraviolet light at one time, and adjusting a light quantity of ultraviolet light emitted to the ink droplets deposited on the print medium to a light quantity for temporarily curing the ink droplets and/or to a light quantity for finally curing the ink droplets.

12. The printing method as claimed in claim 11, further comprising moving a light source for emitting the ultraviolet light along and relative to the print medium.

13. The printing method as claimed in claim 12, wherein the emitting of ultraviolet light further includes adjusting the light quantity of ultraviolet light irradiating the ink droplets deposited on the print medium to the light quantity for temporarily curing the ink droplets and/or to the light quantity for finally curing the ink droplets by adjusting at least one of the irradiation intensity and a moving speed of the light source.

14. The printing method as claimed in claim 13, wherein the ultraviolet light is emitted by light-emitting diodes configured to emit ultraviolet light toward the print medium.

15. The printing method as claimed in claim 11, wherein the ultraviolet light is emitted by light-emitting diodes configured to emit ultraviolet light toward the print medium.

* * * * *